US009406451B2

(12) United States Patent
Schrag et al.

(10) Patent No.: US 9,406,451 B2
(45) Date of Patent: Aug. 2, 2016

(54) METHOD AND APPARATUS FOR DETERMINING THE WEAR ON A CONTACT ELEMENT

(75) Inventors: Daniel Schrag, Lufingen (CH); Kai Hencken, Lörrach (DE); Eldin Smajic, Derendingen (CH)

(73) Assignee: ABB RESEARCH LTD, Zürich (CH)

( * ) Notice: Subject to any disclaimer, the term of this patent is extended or adjusted under 35 U.S.C. 154(b) by 902 days.

(21) Appl. No.: 13/480,927

(22) Filed: May 25, 2012

(65) Prior Publication Data

US 2012/0253695 A1 Oct. 4, 2012

Related U.S. Application Data

(63) Continuation of application No. PCT/EP2010/066346, filed on Oct. 28, 2010.

(30) Foreign Application Priority Data

Nov. 25, 2009 (EP) ..... 09177112

(51) Int. Cl.
*H01H 1/00* (2006.01)
*H01H 33/664* (2006.01)

(52) U.S. Cl.
CPC ..... *H01H 1/0015* (2013.01); *H01H 33/6643* (2013.01); *H01H 2001/0031* (2013.01)

(58) Field of Classification Search
CPC ..... H01H 1/0015
USPC ..... 702/34
See application file for complete search history.

(56) References Cited

U.S. PATENT DOCUMENTS

2004/0223276 A1* 11/2004 Wimmer ..... 361/93.6
2007/0222427 A1* 9/2007 Takeuchi et al. ..... 324/71.2

FOREIGN PATENT DOCUMENTS

DE 102 04 849 A1 8/2002
EP 1 318 533 A1 6/2003
EP 1 475 813 A1 11/2004

OTHER PUBLICATIONS

Ronald L. Graham, Donald E Knuth, Oren Patashnik, Concrete Mathematics, 1994, Chapter 2.*

(Continued)

*Primary Examiner* — Manuel Rivera Vargas
(74) *Attorney, Agent, or Firm* — Buchanan Ingersoll & Rooney PC

(57) ABSTRACT

A method for determining the wear on a contact element of an electrical switch, for example, of a switching installation for high or medium voltage, includes recording electrical values which represent an electrical variable, which is relevant to an arc occurring at the switch during a switching operation, as a function of time, and calculating a wear value, which represents the wear on the contact element, from a plurality of wear contribution values. The wear contribution values are calculated from a plurality of subsets of the recorded electrical values using a plurality of wear contribution calculation rules, with the result that each of the wear contribution values is calculated from a respective one of the subsets of values according to a respective one of the wear contribution calculation rules. At least two of the wear contribution calculation rules differ from one another.

23 Claims, 2 Drawing Sheets

(56) References Cited

OTHER PUBLICATIONS

Notification Concerning Transmittal of International Preliminary Report on Patentability (Forms PCT/IB/326 and PCT/IB/373) and the Written Opinion of the International Searching Authority (Form PCT/ISA/237) issued on Jun. 7, 2012, in corresponding International Application No. PCT/EP2010/066346. (7 pages).
Notification of Transmittal of Translation of the International Preliminary Report on Patentability (Forms PCT/IB/338 and PCT/IB/373) and the Written Opinion of the International Searching Authority (Form PCT/ISA/237) issued on Jun. 14, 2012, in corresponding International Application No. PCT/EP2010/066346. (6 pages).
International Search Report (PCT/ISA/210) issued on Feb. 1, 2011, by the European Patent Office as the International Searching Authority for International Application No. PCT/EP2010/066346.
Written Opinion (PCT/ISA/237) issued on Feb. 1, 2011, by the European Patent Office as the International Searching Authority for International Application No. PCT/EP2010/066346.
Search Report issued on Apr. 19, 2010, by the European Patent Office for Application No. 091771121.

* cited by examiner

METHOD AND APPARATUS FOR DETERMINING THE WEAR ON A CONTACT ELEMENT

RELATED APPLICATIONS

This application claims priority as a continuation application under 35 U.S.C. §120 to PCT/EP2010/066346, which was filed as an International Application on Oct. 28, 2010 designating the U.S., and which claims priority to European Application 09177112.1 filed in Europe on Nov. 25, 2009. The entire contents of these applications are hereby incorporated by reference in their entireties.

FIELD

The present disclosure relates to the field of electrical switches, for example, in switching installations for high or medium voltage. The present disclosure also relates to a method for determining the wear on a contact element of such a switch, and to an electronic unit for an electrical switch.

BACKGROUND INFORMATION

Circuit breakers are subject to continual wear and should therefore be monitored and maintained regularly. For instance, the arc that occurs during a switching operation (e.g., a protective shutdown) leads to material wear on the contact pieces and thus makes a considerable contribution to the wear. Contacts generally cannot be checked in a simple manner, without cost-intensive disassembly and turn-off of the power. Therefore, periodic circuit breaker maintenance is usually performed, if appropriate with maintenance brought forward if protective shutdowns with high currents have occurred. Therefore, in general the switch is maintained too often. The maintenance causes avoidable costs, and an additional risk of damage being caused during maintenance. On the other hand, in the case of excessively long maintenance intervals, there is a risk, however, of wear or contact wear not being identified at an early stage. Here there is the risk of a malfunction, but at the least a loss of performance of the switch.

Therefore, it would be desirable to determine the wear on the contact pieces more reliably. However, the wear is difficult to measure or predict since it is influenced by a multiplicity of factors. It is generally assumed that the contact wear is brought about by the cumulative energy conversion (power loss) when an arc occurs with the circuit breaker having been opened. Solely counting the number of faults that have occurred at a circuit breaker therefore cannot yield an accurate estimation with regard to the contact wear.

EP 1475813 A1 describes methods for determining contact wear in electrical switching installations for high or medium voltage, wherein a contact current that flows through the switch during a switching operation is recorded with the aid of a current converter and an evaluation is made with regard to contact wear. In order to determine a state variable characterizing the contact wear, a current measurement signal of the current converter is first measured as a function of time, the presence of a measurement error is detected upon the occurrence of deviations between the expected contact current and the current measurement signal, and, upon detection of the measurement error, at least one characteristic current value is determined from the current measurement signal and used for determining the state variable. DE 10204849 A1 also describes a method for determining contact wear.

However, the known methods for determining wear can still be improved with regard to their reliability. It is also desirable to obtain methods which, in a multiplicity of different switching situations, yield such reliable results that they are suitable for automated (e.g., remote) diagnosis and maintenance. Cost-intensive maintenance work can be reduced in this way. At the same time, reliable continuous state monitoring can be realized. It is also desirable to identify and eliminate problems and wear before they become critical.

SUMMARY

An exemplary embodiment of the present disclosure provides a method for determining the wear on a contact element of an electrical switch. The exemplary method includes recording electrical values (I(t), U(t)) which represent an electrical variable, which is relevant to an arc occurring at the switch during a switching operation, as a function of time. The exemplary method also includes calculating a wear value (d), which represents the wear on the contact element, from a plurality of wear contribution values. The wear contribution values are calculated from a plurality of subsets ($I(t_i)$; $I([t_i; t'_i])$) of the recorded electrical values using a plurality of wear contribution calculation rules ($f_i$), such that each of the wear contribution values is calculated from a respective one of the subsets of values ($I(t_i)$; $I([t_i;t'_i])$) according to a respective one of the wear contribution calculation rules ($f_i$). At least two of the wear contribution calculation rules ($f_i$) differ from one another.

An exemplary embodiment of the present disclosure provides an electronic unit for an electrical switch. The exemplary electronic unit includes a value input module for obtaining electrical values which represent a variable, which is relevant to the power flowing through the switch during a switching operation, as a function of time. The exemplary electronic unit also includes a wear determination module having a computation unit and a non-transitory data memory having an executable program recorded thereon for execution by the computation unit. The program includes a plurality of wear contribution calculation rules ($f_i$) for calculating respective wear contribution values from respective subsets ($I(t_i)$; $I([t_i;t'_i])$) of the recorded electrical values. At least two of the wear contribution calculation rules ($f_i$) differ from one another. The program also includes a wear value calculation routine for calculating a wear value (d), which represents the wear on a contact element, from the wear contribution values.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
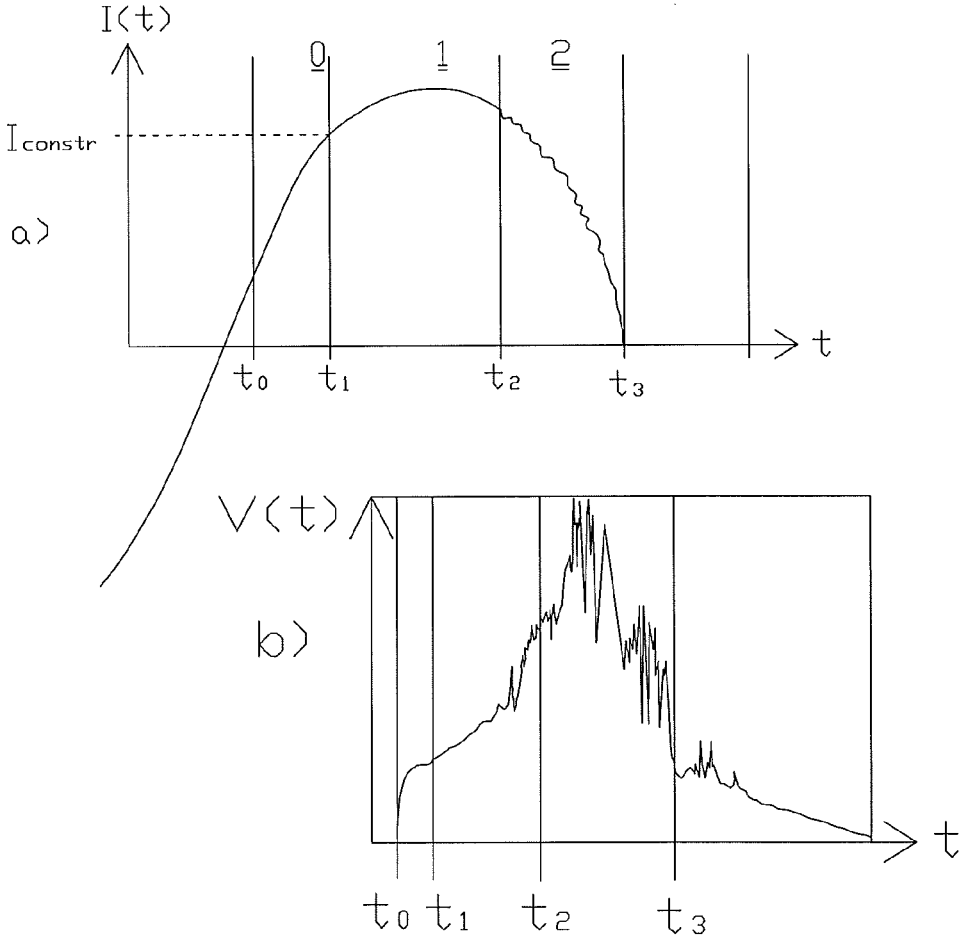
FIG. 1*a* shows a diagram depicting the measured current that occurs during a switching operation as a function of time, according to an exemplary embodiment of the present disclosure.
FIG. 1*b* shows a diagram depicting the measured voltage (more precisely, the arc voltage) that occurs during a switching operation as a function of time, according to an exemplary embodiment of the present disclosure.

In order to improve at least some of the drawbacks associated with known techniques as mentioned above, the present disclosure provides a method for determining the wear on a contact element of an electrical switch, an electronic unit (e.g., a switch controller) for an electrical switch, and a switching installation which can include the electronic unit and/or perform the method of the present disclosure. Further advantages, features, aspects and details of the present disclosure are described below with reference to exemplary embodiments of the present disclosure, as illustrated in the drawings.

An exemplary embodiment of the present disclosure provides a method for determining the wear on a contact element of an electrical switch (e.g. a vacuum switch), for example, of a switching installation for high or medium voltage. The method includes recording electrical values which represent an electrical variable, which is relevant to an arc occurring at the switch during a switching operation, as a function of time. The electrical values can be recorded, for example, as a continuous function or as a data series (vector) with discretely sampled values, but can also include virtual values, for example, (partly) simulated, interpolated, or fitted values, in which case virtual values are recorded. By way of example, the electrical values can be current values which represent a contact current flowing through the switch during a switching operation as a function of time. The method furthermore includes calculating a wear value, which represents the wear on the contact element, from a plurality of wear contribution values. The wear contribution values are calculated from a plurality of subsets of the recorded electrical values using a plurality of wear contribution calculation rules, with the result that each of the wear contribution values is calculated from a respective one of the subsets of values according to a respective one of the wear contribution calculation rules. At least two of the wear contribution calculation rules differ from one another. In this case, a subset of values should be understood such that it can also include all of the recorded electrical values.

An exemplary embodiment of the present disclosure provides an electronic unit, for example, a control and/or monitoring system, for an electrical switch (e.g. a vacuum switch), for example, for a switching installation for high or medium voltage. The electronic unit includes a value input module for obtaining electrical values (e.g. current values) which represent an electrical variable, which is relevant to an arc occurring at the switch during a switching operation, as a function of time. The value input module can therefore be equipped, for example, for obtaining recorded electrical values from a value measuring device, but possibly also electrical values recorded by (partial) simulation or interpolation, etc. The electronic unit furthermore includes a wear determination module having a computation unit and a non-transitory data memory (e.g., a computer-readable recording medium such as a non-volatile memory) having an executable program recorded thereon which can be executed by the computation unit. The program, including instructions of the program, includes a plurality of wear contribution calculation rules which are intended to calculate respective wear contribution values from respective subsets of the recorded electrical values. At least two of the wear contribution calculation rules differ from one another. The electronic unit also includes a wear value calculation routine for calculating a wear value, which represents the wear on the contact element, from the wear contribution values. According to an exemplary embodiment, the program can include rules and/or instructions for executing any of the methods mentioned herein.

The present disclosure also relates to an apparatus for performing the methods disclosed and also includes apparatus parts for performing respective individual method steps. The method steps can be performed by hardware components, by a computer programmed by means of corresponding software, by a combination of both, or in any other manner. The present disclosure is furthermore also directed to methods in accordance with which the apparatuses respectively described operate. It includes method steps for performing each function of the apparatuses.

In the case of the embodiments described below, individual aspects and features can be combined modularly with the aspects and features of other embodiments. By means of such combination, further embodiments can in turn be obtained, which should likewise be regarded as associated with the present disclosure. A switch for a single phase is described below. Three phases with a respectively associated circuit breaker are generally present. The respective instances of wear can then generally be determined independently of one another, in accordance with any of the aspects described herein.

A description is given below principally of those embodiments in which current values are recorded, and the wear contributions are calculated from the current values. More generally, the wear contributions can also be calculated from other electrical values. In this case, electrical values are understood to be any values of variables which are relevant to an arc occurring at the switch during a switching operation. For example, the electrical values can be current values, voltage values and/or combinations thereof (e.g. arc power values formed by a product of current and voltage). The computation rules mentioned herein on the basis of the current are analogously also applicable on the basis of such further electrical values, by replacement of the current values I in the same computation rules by the other electrical values.

Electrical switches such as those which are used, for example, as circuit breakers in a switching installation for high or medium voltage usually have two or more contact pieces. With the switch closed, the contact pieces are in electrically conductive direct contact with one another. When the switch is opened, the contact pieces are moved away from one another and separated, such that current can no longer flow from one contact piece to the other contact piece. If a current flows during the switching process, then during the separation of the two contact pieces from one another the current flow is not immediately interrupted completely, rather an arc arises between the two contact pieces, which continues to carry the current for a certain time. Such an arc also occurs in circuit breakers, for example, special types of switch which are designed to switch under load, and especially in the case of circuit breakers for high voltage (e.g., voltages of more than 50 kV, e.g. 50-800 kV), or for medium voltage (e.g., voltages of 5 kV to 50 kV).

Figure 4:
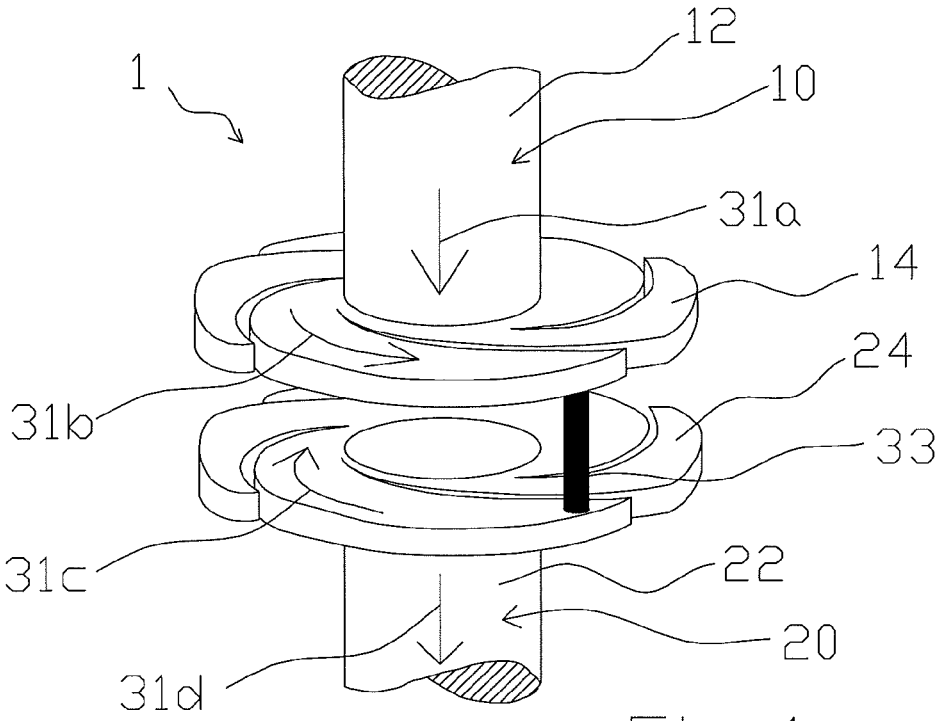
FIG. 4 shows contact elements of an electrical switch according to an exemplary embodiment of the present disclosure.

Such a switching process under load with an arc is illustrated in FIG. 4 on the basis of the example of a vacuum circuit breaker. The vacuum circuit breaker 1 has a first contact piece 10 and a second contact piece 20. The contact pieces 10, 20 respectively have a shaft 12, 22 and a contact plate 14, 24 arranged at the distal end of the shaft. The contact plate 14, 24 of each of the contact pieces 10, 20 in each case has a contact surface which, with the switch closed, makes direct contact with a corresponding contact surface of the respective other contact piece. The two contact pieces 10, 20 define a switching axis along which they can be moved apart relative to one another for the purpose of opening the switch. Said axis is the vertical in FIG. 4.

FIG. 4 illustrates the switch 1 during opening, and the contact pieces 10, 20 have already been separated from one another along the switching axis. The interruption of the current has not yet been fully concluded in FIG. 4, and an arc 33 has formed between the contact pieces 10 and 20. In a manner mediated by the arc 33, a current still flows from the first contact piece 10 to the second contact piece. The current flows via the shaft 12 (current path 31*a*), via the contact plate 14 (current path 31*b*), then via the arc 33, and via the contact plate 24 (current path 31*c*) and via the shaft 22 (current path 31*d*). Under the influence of the arc, material of the contact pieces is eroded (this material usually forms the plasma of the arc), which leads to wear on the contact pieces.

In the example illustrated, the contact pieces 10, 20 are designed as the TMF type. TMF type means that the contact pieces are designed such that the switching current during a switching process brings about a predominantly transverse magnetic field (perpendicular to the general current flow direction or to a main direction of the arc, i.e. parallel to an area defined by the contact surfaces 14 and 24). This is achieved here by means of slots in the contact plates 14 and 24. The slots predefine a current flow direction of the current 31*b*, 31*c* in the plates such that the current induces a transverse magnetic field (in the horizontal plane in FIG. 4). The switch shown in FIG. 4 is of the spiral type (i.e. with spirally fashioned slots). Other forms of the contact pieces are also possible. One possible alternative form for switches of the TMF type is e.g. cup-shaped contact pieces.

The switch illustrated in FIG. 4 is a vacuum circuit breaker (i.e. with a vacuum in the switching area in which an arc is expected, in particular with a high vacuum). Even though some advantages of the present disclosure can be realized particularly well for vacuum circuit breakers for instance in the medium- or high-voltage range, they are not restricted to such switches. Aspects of the present disclosure can likewise relate to e.g. an inert gas circuit breaker, in which the switching area is filled with an inert gas such as $SF_6$, for example.

One difficulty in the case of switches, and in particular in the case of circuit breakers, is the wear on the contact pieces (e.g. contact pieces 10, 20 in FIG. 4) as a result of the arc (33 in FIG. 4). The problems brought about by the wear or the accompanying wear of the switch have already been described further above. For the reasons mentioned above it is desirable to determine the wear as accurately as possible.

One method mentioned here for illustration purposes provides for this purpose a current integral of the following form, for instance, for determining the wear:

$$d=k*\int I(t)^{\alpha}dt \quad (1)$$

The wear is indicated here by a thickness d (in mm) by which, during a switching process, material is eroded from the contact surface of the contact piece on account of the arc. In this case, I(t) represents the contact current flowing through the switch during a switching operation as function of time t, i.e. the current which flows through the arc 33 at the time t, see FIG. 4. k and $\alpha$ are constants which can be determined e.g. by a model or empirically. The time integral in (1) relates to the total switching time during which an arc is present. An integral such as in equation (1) is intended herein also to express a sum of discrete current values which is suitably approximated by such an integral.

However, the computation rule (1) yields inaccurate results particularly for medium or high switching currents. If the parameters k and $\alpha$ are calibrated for low switching currents, then the wear for high switching currents and long arc durations (phase length 0.75 $\pi$ or more) tends to be overestimated by the rule (1), and the wear for medium or high switching currents and short arc durations (phase length 0.25 $\pi$ or less) tends to be underestimated. Therefore, the issue arises of wanting a more realistic or more accurate rule for determining the wear d also for a wide range of switching currents and arc durations. For this purpose, there might be occasion to replace the integrand in (1) by a more complex expression (having more parameters to be adapted empirically). However, the accuracy that can be achieved with such an approach is likewise limited and cannot justify the increase in the number of parameters to be adapted.

According to the present disclosure, these difficulties are at least alleviated by the following method for determining the wear on the contact element: firstly, the current values I(t) which represent the contact current flowing through the switch during a switching operation are recorded as a function of time t. The current values I(t) can be recorded as a continuous function or as a data series (vector) were discretely sampled values. The sampled current values can comprise not only measured values but also virtual values, e.g. values that are fitted or interpolated or simulated on the basis of the measurement values and/or a suitable model. By way of example, the current can be assumed to be sinusoidal, and the amplitude and phase and, if necessary, the frequency of the signal can be adapted on the basis of measured values, thus resulting in good correspondence of the sinusoidal current to the measured values.

The wear value d is then calculated from a plurality of N wear contribution values $d_i$, i=1 . . . N (for instance as a sum of the wear contribution values). The wear contribution values $d_i$ are in turn calculated from a plurality of subsets of the recorded current values I(t) using a plurality of wear contribution calculation rules $f_i$, with the result that each of the wear contribution values is calculated from a respective one of the subsets of current values according to a respective one of the wear contribution calculation rules $f_i$ (a subset of current values can also comprise all of the recorded current values, that is to say can be a proper or an improper subset). In this case, at least two of the wear contribution calculation rules differ from one another (as functionals or mappings).

One aspect of the present disclosure is based on the insight that different arc phases occur during a switching process. Said arc phases approximately succeed one another temporally. Said different arc phases lead to respectively different wear on the contact pieces, that is to say that the wear is dependent on the current differently, depending on the arc phase: whereas a diffuse arc, for instance, leads to rather uniform and minor wear on different parts of the contact piece, a stationary constricted arc leads to intensive wear on a limited part of the contact piece, and is thus more relevant overall to the wear.

The method according to the present disclosure advantageously makes it possible to calculate the contribution of different arc phases to the wear of the contact element as a respective dedicated wear contribution value. Each of the wear contribution values can be calculated by means of a wear contribution calculation rule specific to the respective arc phase. For this purpose, it is advantageous to choose the subsets of current values and/or the wear contribution calculation rules such that a specific recorded current value, depending on the arc phase in which it occurs, leads to a respectively different wear contribution.

For this purpose, firstly it is necessary to determine the respective subsets of current values. As subsets of current values it is possible to determine those current values which belong to a respective arc phase. For this purpose, it is possible to determine the intervals of time for the respective arc phases (e.g. for ith arc phase the time interval $[t_i;t'_i]$ from $t_i$ to $t'_i$), and it is possible to choose the subsets of current values as the subsets of current values $I([t_i;t'_i])$ associated with the respective time interval $[t_i;t'_i]$. For this purpose, the limit times $t_i$, $t'_i$ for the respective arc phase are suitably determined (see further below), and the subsets of current values are defined taking these times into account.

The temporal delimitation between the individual arc phases can be somewhat blurred, with transition periods therebetween. Nevertheless, it is possible to determine at least approximately a limit time for the limit (start or end) of a phase, that is to say $t_i$ for the start or $t'_i$ for the end of the ith arc phase. Generally, such a limit time can be either a start time for the start of the arc (or of the first arc phase), or a transition time for the transition from one phase to a respective next phase, or an end time for the end of the arc (or of the last arc phase). Accordingly, the transition time does not relate to the start or the end of the arc as such, since different arc phases do not merge into one another here.

In the case of TMF switches, the type and movement of the arc can be recorded by observations on specially shaped contact pieces. In this case, in an exemplary TMF switch it was possible to distinguish the following different arc phases from one another:

(i) phase with diffuse arc: the arc is spatially distributed over a wide area on the contact piece;

(ii) phase with constricted stationary arc: the arc is constricted to a narrow region from which it extends perpendicular to the contact surface, and is stationary, e.g., hardly moves along the contact surface;

(iii) phase with constricted moving arc: the arc is still constricted to a narrow region, but moves at high speed (i.e. at a significantly higher speed than in the phase before) along the contact surface.

After the conclusion of the last phase, the arc is extinguished (possibly with a further phase with a diffuse arc before complete extinction). Depending on the configuration of the switch and the contact pieces, the phases can differ from the phases mentioned above, and there can be further phases or fewer phases or phases of a different type than the phases described above.

In the above example, therefore, it is possible to determine as the limit time a start time $t_0$ (or, more precisely, $t_{open}$) for the start of the diffuse arc, a transition time $t'_0=t_1$ for the transition from the diffuse arc to the constricted stationary arc, a further transition time $t'_1=t_2$ for the transition from the constricted stationary arc to the wandering arc, and an end time $t'_2=t_3$ for the end of the wandering arc. If these transition periods are determined in a suitable manner, then the subsets of current values can be determined as a first, second and third subset of current values $I([t_0;t'_0])$, $I([t_1;t'_1])$, $I([t_2;t'_2])$.

Referring to FIGS. 1*a* and 1*b*, a description will now be given of how the limit times which delimit the arc phases can specifically be determined.

FIGS. 1*a* and 1*b* show diagrams respectively depicting the current I occurring during a switching operation (FIG. 1*a*, vertical axis) and the arc voltage U (FIG. 1*b*, vertical axis) as a function of time t (horizontal axis). In the schematic drawings in FIGS. 1*a* and 1*b*, the time axis is not to scale; therefore, the times $t_0$ to $t_3$ lie at somewhat different positions in FIGS. 1*a* and 1*b*. The current has generally an approximately sinusoidal profile, with an envelope modulated onto a fundamental frequency. FIGS. 1*a* and 1*b* illustrate only part of a sinusoidal oscillation period, with a zero crossing before the time $t_0$.

The current illustrated in FIG. 1*b* represents an overcurrent. On account of the overcurrent, the switch controller outputs a switching signal that instigates the separation of the contact pieces of the switch. A short time thereafter, the switch controller outputs a switching signal that instigates the separation of the contact pieces of the switch. The contact pieces are then moved apart and separate approximately at the time $t_0$. This separation can be identified by the fact that, in FIG. 1*b*, the voltage suddenly rises, and an arc occurs. Approximately at the same time, the arc starts as a diffuse arc. The separation of the contact pieces or the voltage rise discernible in FIG. 1*b* can be used as the start of the diffuse arc ($1^{st}$ arc phase), which defines the time $t_0$. In some embodiments, the minor contact wear during the diffuse arc phase can be disregarded.

At the time $t_1=t'_0$, the diffuse arc undergoes transition to a constricted stationary arc. This transition can be recorded e.g. by virtue of the fact that the current overshoots a predefined current threshold $I_{constr}$. The exact choice of the threshold value $I_{constr}$ is dependent on the geometry of the contact pieces and on further details, and can be calibrated e.g. by measurements. Through various observations it was ascertained that $I_{constr}$ can generally be more than 10 kA, that is to say e.g. 15 kA. Alternatively, the transition to the constricted stationary arc can also be defined in some other way. Further possible alternatives for determination are described further below.

At the time $t_2=t'_1$ the stationary arc undergoes transition to a moving arc, under the influence of the transverse magnetic field generated by the flowing current. The movement of the arc leads to an increased noise component in the measured voltage and the measured current. Therefore, the transition to the moving arc can be recorded by virtue of the fact that the noise component in the voltage (ratio of the variance in a predefined frequency range to an averaged value of the voltage) overshoots a predefined threshold. The exact choice of the frequency range and the threshold value is dependent on the geometry of the contact pieces and on further details, e.g. the evaluation of the noise signal is particularly meaningful in the case of the spiral TMF type. The threshold value etc. can be calibrated e.g. by measurements. Alternatively, the transition to the constricted stationary arc can also be defined in some other way, as described further below.

At the time $t_3=t'_2$ the arc is extinguished, and the arc phase thus ends as well. This time can be identified e.g. by virtue of the fact that the current decreases significantly. More generally, the time $t_3$ can be defined by a decrease in the current and/or voltage to below a predefined limit value.

In order to determine the abovementioned limit times which delimit the individual arc phases, it is also possible to use further events which are correlated in some way with the start or the end of an arc phase. Such an event can be, for example:

a. the start of an arc (for instance can be determined by the measurement of the brightness in the arc region, the contact current, the contact voltage, or a similar variable);

b. a transition from a stationary arc state to a wandering arc state (can be determined for instance by the measurement of the variance or the noise component of the abovementioned variables);

c. transition from a diffuse arc to a constricted arc (can be determined for instance by the measurement of the spatial brightness distribution in the arc region);

d. the end of an arc (can be determined for instance by the measurement of the brightness in the arc region, the contact current, the contact voltage, or a similar variable);

e. the separation of a contact element from a further contact element of the switch (can be determined for instance by mechanical measurement or by evaluation of a switching signal transmitted by a contact controller; this can involve the contact element to be examined or alternatively a further contact element);

f. the removal of the contact element from a further contact element of the switch by a distance which exceeds a predefined distance threshold value (can be determined for instance by mechanical measurement);

g. the issue or evaluation of a switching command (for instance by a switch controller);

h. the overshooting or undershooting of a predetermined threshold value via a recorded value, wherein the recorded value is selected, for example, from a list comprising the following measurement values:

current value and/or voltage value and/or value of an electric or magnetic field (can be determined for instance by measurement transducers);

frequency component of a current value and/or of a voltage value;

brightness value of an arc;

position value which describes a position of the contact surface and/or a distance between two contact surfaces;

previous wear value of the contact piece, for instance during a previous switching process;

previous total wear value of the contact piece, i.e. the sum of the wear values of all previous switching processes;

period of time elapsed since the occurrence of any further event, for example one of the events mentioned in this list; and/or possibly the period of time elapsed since an earlier limit time.

The limit time can be chosen, for example, as the time of a corresponding event. The limit time can also be calculated taking account of a plurality of the events mentioned, for instance by logical or weighted combination of a plurality of events or by averaging of a plurality of corresponding times. The limit time is, for example, a transition time representing a transition from a stationary arc state to a wandering arc state.

The at least one limit time can also be determined taking into account at least one of the following measurement values:

current value;

voltage value;

value of an electric or magnetic field;

noise component or frequency component of a current value;

noise component or frequency component of a voltage value;

noise component or frequency component of an electric or magnetic field;

brightness value of an arc;

position value which describes a position of the contact surface and/or a distance between two contact surfaces (wherein, for example, one of the contact elements is the contact element to be examined; alternatively, a further contact element can be involved);

previous wear value;

previous total wear value;

period of time elapsed since the occurrence of any event, for example one of the events mentioned above;

possibly period of time elapsed since an earlier limit time.

Depending on the availability of measurement values and events, it is possible to select elements from the above list and to suitably calibrate the determination rules for a respective arc phase. It is also possible to employ a plurality of determination rules and to combine their results, e.g. by averaging or forming a weighted average value.

In accordance with an exemplary embodiment, the respective intervals of time for the subsets of current values can be determined, for example, in the following manner:

| No. | Arc phase | Criterion for determining the start of the phase |
|---|---|---|
| 0 | Diffuse arc | Separation of the contact pieces (determined e.g. by means of evaluation of a switching command or by means of mechanical sensors) |
| 1 | Constricted stationary arc | Contact current exceeds a threshold value Iconstr, e.g. 10 kA |
| 2 | Constricted rotating arc | Noise component of the current or of the voltage exceeds a threshold value |

The end of the constricted rotating arc (phase 2) can be determined e.g. by virtue of the current again undershooting a predefined threshold value.

Figure 2:
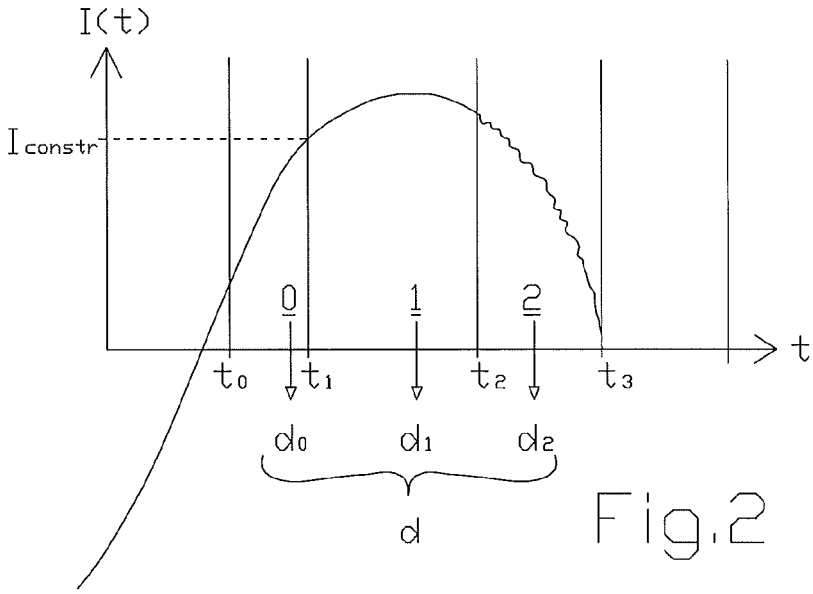
FIG. 2 shows a diagram depicting the current that occurs during a switching operation as a function of time, from which various arc phases of the switching operation are derived, according to an exemplary embodiment of the present disclosure.

The numbers in the left column refer to the time segments illustrated in Figures FIGS. 1*a* and 2. FIGS. 1*a* and 2 schematically show the possible associated current and voltage values on the basis of which the classification described in the table could at least be effected.

As is shown in FIG. 2, it is possible to subdivide the current values on the basis of the determined limit times into different subsets of current values. A first subset of current values includes the current values $I([t_0;t_1])$ in the interval of time $[t_0;t_1]$ (reference sign 1). A second subset of current values includes the current values $I([t_1;t_2])$ in the interval of time $[t_1;t_2]$ (reference sign 2). A third subset of current values includes the current values $I([t_2;t_3])$ in the interval of time $[t_2;t_3]$ (reference sign 3). For each of the subsets of current values, a respective wear contribution value $d_1$, $d_2$ and $d_3$ is calculated using a respective wear contribution calculation rule. The wear contribution values $d_1$, $d_2$ and $d_3$ are subsequently combined (e.g. added) to form the wear value d.

Generally, in order to calculate the wear value, therefore, at least one transition time is determined, which, for example, represents a respective transition between different phases of an arc occurring during the switching operation. The intervals of time are defined, for example, such that the transition time defines a transition between a first one of the intervals of time $[t_i;t'_i]$ and a second one of the intervals of time $[t_j;t'_j]$ such that $t'_i=t_j$ is formed by the transition time. For example, the method can involve defining an end $t'_i$ of the first interval of time $[t_i;t'_i]$ and a start $t_j$ of the second interval of time $[t_j;t'_j]$ taking account of the transition time determined, e.g. such that the transition time lies between the first interval of time and the second interval of time; for example such that the first interval of time is earlier than or identical to the transition time, and the second interval of time is later than or identical to the transition time. In other words, the first interval of time then precedes the second interval of time, with the transition time therebetween. The subsets of current values are then determined taking account of the at least one transition time determined.

The subsets of current values $I([t_i;t'_i])$ are accordingly determined as the current values associated with a respective interval of time $[t_i;t'_i]$. At least one of the intervals of time $[t_i;t'_i]$ is defined taking account of the at least one limit or transition time determined.

Possible embodiments of the individual wear contribution calculation rules (per subset of current values or per arc phase) are described below. In one embodiment, at least one, or else all, of the wear contribution calculation rules is/are evaluated as a respective integral of the form (1) (or as a sum approximated by such an integral), wherein the respective time integral or the sum is restricted only to the respective interval of time or the respective subset of current values. The respective parameter k and $\alpha$ in (1) can then be chosen in each case separately per subset of current values (or per arc phase), e.g. can be predefined on the basis of a model or calibrated on the basis of measurements.

A wear contribution calculation rule $f_i$ for the ith subset of current values (represented here as the subset of current values associated with the interval of time $[t_i;t'_i]$) can then be formulated as $$f_i[I] = k_i * \int_{t_i}^{t'_i} I(t)^{\alpha_i} dt \text{ (as integral) or as} \tag{2}$$

$$f_i[I] = K_i * \sum_{t\in[t_i;t'_i]} I(t)^{\alpha_i} \text{ (as sum),} \tag{2'}$$

wherein $k_i$ and. $K_i$, $\alpha_i$ correspond to the parameters k and $\alpha$ in (1). In equation (2'), the parameter K is capitalized in order to indicate the different physical unit by comparison with the parameter k from equations (1) and (2): $[k]=\text{cm A}^{-\alpha i}\ \text{s}^{-1}$; $[K]=\text{cm A}^{-\alpha i}$. Otherwise, the parameters k and K are equivalent. In one embodiment, it is possible to choose the form (2) or (2') for two subsets of current values (e.g. first (i=1) and second (i=2) subsets of current values) where $\alpha_1\neq\alpha_2$ or $K_1\neq K_2$. For example, in embodiments, $0.5\leq\alpha_1,\alpha_2\leq 2$.

However, calculation rules other than (2), (2') are also possible. In general, the calculation rule includes forming a contribution in the form $$f_i[I] = \int_{t_i}^{t'_i} \varphi_i(I(t))dt \tag{3}$$

$$f_i[I] = \sum_{t\in[t_i;t'_i]} \varphi_i(I(t)) \tag{3'}$$

for at least two of the wear contributions (where i=1 for a first wear contribution and i=2 for a second wear contribution, such that $\phi_1\neq\phi_2$, wherein the inequality sign here denotes: "not identical as functions"). Here, I(t) respectively denotes a current value included in the subset of current values associated with the ith wear contribution. Equations (2) and (2') are special cases of (3) and (3'), respectively, e.g. where $\phi_i(I(t)) = K_i * I(t)^{\alpha_i}$.

The wear value can then be calculated as the sum of the individual wear contributions $d_i=f_i[I]$, i=0 . . . (N-1), for instance in the form $$d = \sum_i d_i = \sum_i f_i[I],$$

where $f_i$ denotes one of the wear contribution calculation rules described herein.

In (2') for the wear contribution calculation rule $f_i$ summation is effected only within the limits $t_i$ to $t'_i$. Instead of a hard limit for these sums, summation can also be effected over a longer period of time, wherein the contributions are weighted with a time-dependent function $\gamma_i(t)$ which is greater inside an interval of time $[t_i, t'_i]$ than outside the interval of time. Any correspondingly generalized equation (2') then has the following form:

$$f_i[I] = K_i * \sum_t \gamma_i(t) * I(t)^{\alpha_i} \tag{4}$$

Figure 3:
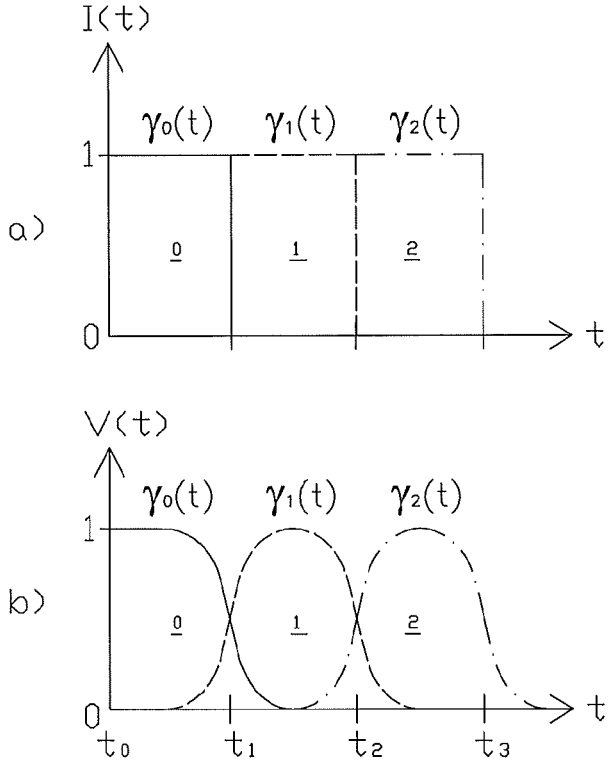
FIGS. 3*a* and 3*b* show respective possible auxiliary functions which can be used for calculating a wear value in the manner according to present disclosure an exemplary embodiment of the present disclosure.

Examples of the functions $\gamma_i(t)$ are illustrated in FIG. 3. FIG. 3*a* shows functions $\gamma_i(t)$ as step functions having the value 1 inside an interval of time between $t_i$ and $t'_i=t_{i+1}$ and the value 0 outside the interval of time. With these functions $\gamma_i(t)$ from FIG. 3*a*, the sum of equation (4) is again converted into the more specific form of equation (2).

An alternative function $\gamma_i(t)$ is illustrated in FIG. 3*b*. Here, $\gamma_i(t)$ is greater inside the interval of time between $t_i$ and $t'_i=t_{i+1}$ than outside the interval of time, but $\gamma_i(t)$ falls continuously and has a finite value also outside the interval of time. The subsets of current values for different wear contributions over which summation is effected in equation (3) using the functions $\gamma_i(t)$ outlined in FIG. 3*b* then overlap. For example, the subsets of current values can comprise all recorded current values here, and their contribution is merely weighted by means of a suitable function $\gamma_i(t)$.

The function $\gamma_i(t)$ can be expressed as follows: $\gamma_i(t)=\tilde{\gamma}((t-t_i)/(t'_i-t_i))$ where $\gamma$ denotes a function having greater values inside the interval [0;1] than outside the interval. The functions outlined in FIG. 3*a* and FIG. 3*b* are substantially equivalent and lead to very similar results.

In a generalization of equation (4), the wear can be expressed as a sum $$d = \sum_i f_i[I]$$

where $$f_i[I] = \sum_t \gamma_i(t) * \varphi_i(I(t)),$$

wherein, in the example of equation (3), $\phi_i(I(t))=K_i*I(t)^{\alpha_i}$. The function $\phi_i(I(t))$ can be interpreted such that it yields a proportion of the abrasion contribution for every value of I(t).

The above calculation rule can correspondingly also be applied to integrals over current values recorded temporally continuously. In this case, in accordance with the above generalization, the wear can be expressed as the integral $$d = \sum_i k_i \int \gamma_i(t) * \varphi_i(I(t))dt.$$

The integral can be numerically approximated.

Even further possible modifications will be described below. In accordance with one modification, it is possible to calculate the wear contribution values for a plurality of the arc phases with a similar wear characteristic by means of a common wear contribution calculation rule. Nevertheless, not all arc phases should be calculated in the same way, i.e. at least two of the wear contribution calculation rules differ from one another.

In accordance with a further modification, besides the currents I, the arc voltages U are also recorded and taken into account when calculating the wear value. In accordance with one embodiment, the voltages could be recorded e.g. by means of additional voltage sensors. A corresponding wear function could then have the following form, for example:

$$f_i[I, V] = K_i * \sum_{t \in [t_i, t_{i+1}]} I(t)^{\alpha_i} * U(t)^{\beta_i}$$

Generally, any desired electrical value which represents a variable relevant to the power flowing through the switch during a switching operation can be used for the calculation, that is to say e.g. the current I, the arc voltage U, a product thereof (as in the above equation).

In a further embodiment, the power P(t)=I(t)*U(t) as a function of time, instead of I(t), can also be inserted directly into any of the equations mentioned above, e.g. (2), (2'), (3), (3').

In accordance with a further modification, it is also possible to omit individual arc phases which make only an insignificant contribution to the wear. By way of example, the diffuse arc phase (zeroth phase between t0 and t1) can be omitted in the example of FIGS. 1 and 2 for this reason, such that the calculation starts first with the phase i=1.

A description is given below of a switch controller and a switching installation suitable for performing the method described herein. The switch controller includes a current value input module for obtaining current values (e.g. obtaining recorded current values from e.g. a current measuring device, but also from a device for simulation, interpolation, etc.) which represent a contact current flowing through the switch during a switching operation as a function of time. The switch controller furthermore includes a wear determination module having a computation unit (e.g., a processor) and a non-transitory data memory (e.g., a non-volatile memory) having an executable program recorded thereon which can be executed by the computation unit. The program includes a plurality of wear contribution calculation rules $f_i$ which are intended to calculate respective wear contribution values from respective subsets $I([t_i;t'_i])$ of the recorded current values, with the result that each of the wear contribution calculation rules calculates a respective one of the wear contribution values from a respective one of the subsets of current values. At least two of the wear contribution calculation rules $f_i$ differ from one another. The program furthermore includes a wear value calculation routine for calculating a wear value d, which represents the wear on the contact element, from the wear contribution values (e.g. as the sum thereof).

The executable program includes, for example, instructions for executing any method described herein. For example, the wear contribution calculation rules $f_i$ are intended to calculate a corresponding plurality of wear contribution values from a corresponding plurality of subsets $I([t_i;t'_i])$ of the recorded current values, with the result that each of the wear contribution calculation rules $f_i$ calculates a respective one of the wear contribution values from a respective one of the subsets of current values $I([t_i;t'_i])$.

In accordance with an exemplary embodiment, the switching installation is designed for high or medium voltage, and is, for example, a circuit breaker, e.g. a vacuum circuit breaker (but a gas-insulated circuit breaker is also possible). The switching installation includes the switch controller described above. The contact current is, for example, an arc current. The switching installation has, as contact element, for example a contact piece of the TMF type since here there are particularly distinct arc phases. A contact piece of the TMF type is characterized in that its design promotes a predominantly transverse magnetic field during the switching process or during an arc. The transverse magnetic field promotes the movement of the arc and thus leads to pronounced arc phases. The contact piece can be, for example of the spiral TMF type (as illustrated in FIG. 4). The contact element can thus contain a planar contact surface having a round cross section, e.g. having a spiral gap. Alternatively, the contact piece can also be designed in a cup-shaped fashion (of the cup-shaped type). Generally, the switch can contain two contact pieces that are movable relative to one another in a longitudinal direction.

The switching installation can contain a plurality of contact elements (e.g. 3 contact elements for 3 phases). In this case, the wear can occur separately for each of the contact elements as described herein.

The switching installation can furthermore include a diagnosis system, which is connected to the switch controller in order to receive the calculated wear values. The diagnosis system can comprise, for instance, the following functions (separately per phase):

- addition of the wear value to form a total wear value representing the total wear on the contact piece as a sum for a plurality of switching processes;
- triggering of an alarm, warning or blocking command if the wear value or total wear value exceeds a predefined alarm threshold value or warning threshold value or blocking threshold value;
- calculation of a percentage wear as a proportion of a permissible maximum wear that the present wear constitutes (wear value with respect to a total wear value);
- calculation of an expected remaining operating duration of the switch on the basis of the wear value or total wear value;
- forwarding of the wear value determined or of a variable (e.g. total wear value) derived therefrom to an online diagnosis server.

Even further general aspects of the present disclosure will be mentioned below. In accordance with one aspect, a method for determining the wear on a contact element involves calculating a wear value (d), which represents the wear on the contact element, from the recorded current values (I(t)), wherein a first wear contribution value is calculated according to a first wear contribution calculation rule ($f_i$) from the at least one current value ($I(t_i)$; $I([t_i;t'_i])$) for the first interval of time ($t_i$; $[t_i;t'_i]$), and a second wear contribution value is calculated according to a second wear contribution calculation rule ($f_j$) from the at least one current value ($I(t_j)$; $I([t_j;t'_j])$) for the second interval of time ($t_j$; $[t_j t'_j]$), wherein the first wear contribution calculation rule ($f_i$) differs from the second wear contribution calculation rule ($f_j$).

Generally, the wear contribution calculation rule need not be uniform within the respective current values. Recording can comprise a measurement, for example a sampling measurement in discrete sampling time intervals, but also (partial) simulation. The simulation can be based on a model, e.g. assumption that current values lie on a sinusoidal curve, or can comprise an interpolation between measurement values. In this way, the current values can be available as a continuous function of time or as a vector of discrete recorded values.

The wear contribution calculation rule is not identical to zero (as functional). A calculation rule identical to zero as functional would yield no wear contribution at all (i.e. always zero) independently of the electrical values of the subset of values. Such a calculation rule is not regarded as a wear contribution calculation rule.

It will be appreciated by those skilled in the art that the present disclosure can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method for determining the wear on a contact element of an electrical switch, the method comprising:

recording electrical values (I(t), U(t)) which represent an electrical variable, which is relevant to an arc occurring at the switch during a switching operation, as a function of time; and calculating a wear value (d), which represents the wear on the contact element, from a plurality of wear contribution values, wherein the wear contribution values are calculated from a plurality of subsets ($I(t_i)$; $I([t_i;t'_i])$) of the recorded electrical values using a plurality of wear contribution calculation rules ($f_i$), such that each of the wear contribution values is calculated from a respective one of the subsets of values ($I(t_i)$; $I([t_i;t'_i])$) according to a respective one of the wear contribution calculation rules ($f_i$), wherein at least two of the wear contribution calculation rules ($f_i$) differ from one another, and wherein the method comprises:

calculating, based on the calculated wear value, a percentage wear of the contact element of the electrical switch, as a proportion of a maximum wear value that the calculated wear value constitutes;

determining whether the calculated percentage wear is greater than a predefined warning threshold value; and outputting a command to block operation of the electrical switch when the calculated percentage wear is determined to be greater than the predefined warning threshold value.

2. The method as claimed in claim 1, wherein the calculating of the wear value (d) comprises:

determining a transition time ($t_i$, $t'_i$) which is characteristic of a change in the wear contribution calculation rule, wherein the at least one transition time represents a respective transition between different phases of an arc occurring during the switching operation.

3. The method as claimed in claim 2, wherein the calculating of the wear value (d) comprises:

defining at least one of the subsets of values ($I(t_i)$; $I([t_i; t'_i])$) taking into account the at least one transition time ($t_i$, $t_i$) which has been determined.

4. The method as claimed in claim 3, wherein the subsets of values ($I([t_i;t'_i])$) comprise electrical values associated with a respective interval of time ($[t_i;t'_i]$), wherein the method comprises:

for each of the intervals of time, stipulating the start ($t_i$), the end ($t'_i$) or the start and the end of the respective interval of time ($[t_i;t'_i]$) by means of at least one respective limit time ($t_i$, $t'_i$), and wherein the at least one limit time is the at least one transition time.

5. The method as claimed in claim 3, wherein the at least one transition time includes a first transition time ($t_1$) and a second transition time ($t_2$), and wherein the plurality of subsets of values comprise at least a first, a second and a third subset of values ($I([t_0;t_1])$; $I([t_1;t_2])$, $I([t_2;t_3])$).

6. The method as claimed in claim 2, wherein the subsets of values ($I([t_i;t'_i])$) comprise electrical values associated with a respective interval of time ($[t_i;t'_i]$), wherein the method comprises:

for each of the intervals of time, stipulating the start ($t_i$), the end ($t'_i$) or the start and the end of the respective interval of time ($[t_i;t'_i]$)by means of at least one respective limit time ($t_i$, $t_i$), and wherein the at least one limit time is the at least one transition time.

7. The method as claimed in claim 2, wherein the at least one transition time includes a first transition time ($t_i$) and a second transition time ($t_2$), and wherein the plurality of subsets of values comprise at least a first, a second and a third subset of values ($I([t_0;t_1])$; $I([t_1;t_2])$, $I([t_2;t_3])$).

8. The method as claimed in claim 1, wherein the calculating of the wear value (d) comprises:

determining at least one limit time ($t_i$, $t'_i$), wherein the at least one limit time is the at least one transition time, and wherein the at least one limit time is determined taking into account at least one respective value selected from a first list including:

a current value;

a voltage value;

a value of an electric or magnetic field;

a noise component or frequency component of a current value;

a noise component or frequency component of a voltage value;

a noise component or frequency component of an electric or magnetic field;

a brightness value of an arc;

a position value which describes a position of the contact surface and/or a distance between two contact surfaces;

a previous wear value;

a previous total wear value;

a period of time elapsed since the occurrence of an event;

a period of time elapsed since an earlier limit time.

9. The method as claimed in claim 8, wherein the event is selected from a list including:

a. the start of an arc;

b. a transition from a stationary arc state to a wandering arc state;

c. a transition from a diffuse arc to a constricted arc;

d. the end of an arc;

e. a separation of a contact element from a further contact element of the switch;

f. a removal of the contact element from a further contact element of the switch by a distance which exceeds a predefined distance threshold value;

g. an issue or evaluation of a switching command;

h. an overshooting or undershooting of a predetermined threshold value by a recorded value.

10. The method as claimed in claim 1, wherein the switch is a vacuum switch.

11. The method as claimed in claim 10, wherein the switch is comprised in a switching installation for a high or medium voltage.

12. The method as claimed in claim 1, wherein the calculating of the wear value (d) comprises:

determining at least one limit time ($t_i$, $t'_i$), wherein the at least one limit time is the at least one transition time, and wherein the at least one limit time is determined taking into account at least one respective event selected from a first list including:

a. the start of an arc;

b. a transition from a stationary arc state to a wandering arc state;

c. a transition from a diffuse arc to a constricted arc;

d. the end of an arc;

e. a separation of a contact element from a further contact element of the switch;

f. a removal of the contact element from a further contact element of the switch by a distance which exceeds a predefined distance threshold value;

g. an issue or evaluation of a switching command;

h. an overshooting or undershooting of a predetermined threshold value by a recorded value, wherein the recorded value is selected from at least one value in a second list including:

a current value;

a voltage value;

a value of an electric or magnetic field;

a noise component or frequency component of a current value;

a noise component or frequency component of a voltage value;

a noise component or frequency component of an electric or magnetic field;

a brightness value of an arc;

a position value which describes a position of the contact surface and/or a distance between two contact surfaces;

a previous wear value or previous total wear value;

a period of time elapsed since the occurrence of any further event identified in the first list; and a period of time elapsed since an earlier limit time.

13. The method as claimed in claim 1, wherein the subsets of values ($I(t_i)$; $I([t_i;t'_i])$) are determined as the electrical values associated with a respective interval of time ($[t_i t'_{i]}$), *and* wherein the calculation of the wear value (d) includes forming a sum or an integral of the wear contribution values.

14. The method as claimed in claim 1, wherein the calculating of the wear value (d) comprises:

forming a contribution in the form $K_i*I(t)^{\alpha}{}_i$ for at least one of the wear contributions, wherein i indicates a respective one of the at least one wear contribution as an ith wear contribution, and wherein $K_i$ respectively denotes an ith coefficient factor, 1(t) respectively denotes an electrical value included in the subset of values associated with the ith wear contribution, and $\alpha_i$ respectively denotes any desired exponent.

15. The method as claimed in claim 1, wherein the wear value (d) contains an expression of the form $$d = \sum_t f_i(I)$$

where $$f_i(I) = \sum_t Y_i(t)^* \varphi_i(I(t)),$$

wherein $f_i(I)$ denotes an ith of the wear contribution calculation rules, $$\sum_t$$

denotes a sum of time values t with recorded electrical values I(t), $y_i(t)$ denotes a respective [ith] t-dependent weighting factor which provides values of a larger magnitude for t inside the respective [ith] subset of values than for t outside the respective subset of values, and $\phi_i(I(t))$ denotes a respective [ith] function of I, wherein $\phi_i(I(t)) = K_i*I(t)^{\alpha}{}_i$.

16. The method as claimed in claim 1, comprising:

adding the calculated wear value to a total wear value which represents the total wear possibly for a plurality of switching processes.

17. The method as claimed in claim 1, wherein the electrical values comprise at least one value selected from the group consisting of:

current values (I(t)) which represent the contact current flowing through the switch during the switching operation as a function of time;

voltage values (U(t)) which represent the arc voltage present at the switch during the switching operation as a function of time; and arc power values (P(t)) which represent the arc power present at the switch as a function of time.

18. A switching installation for a high or medium voltage, comprising an electronic unit including a processor configured to carry out the method as claimed in claim 1.

19. An electronic unit for an electrical switch, the electronic unit comprising:

a value input module for obtaining electrical values which represent a variable, which is relevant to the power flowing through the switch during a switching operation, as a function of time; and a wear determination module having a computation unit and a non-transitory data memory having an executable program recorded thereon for execution by the computation unit, wherein the program comprises:

a plurality of wear contribution calculation rules ($f_i$) for calculating respective wear contribution values from respective subsets ($I(t_i)$; $I([t_i;t'_i])$) of the recorded electrical values, wherein at least two of the wear contribution calculation rules ($f_i$) differ from one another, a wear value calculation routine for calculating a wear value (d), which represents the wear on a contact element, from the wear contribution values, and a percentage wear calculation routine, which comprises:

calculating, based on the calculated wear value, a percentage wear of the contact element of the electrical switch, as a proportion of a maximum wear value that the calculated wear value constitutes;

determining whether the calculated percentage wear is greater than a predefined warning threshold value; and outputting a command to block operation of the electrical switch when the calculated percentage wear is determined to be greater than the predefined warning threshold value.

20. A switching installation for a high or medium voltage, comprising an electronic unit as claimed in claim 19.

21. The switching installation for a high or medium voltage as claimed in claim 20, wherein the contact element is a contact piece of the transverse magnetic field (TMF) type.

22. The electronic unit as claimed in claim 19, wherein the electronic unit is comprised in a control and/or monitoring system.

23. The electronic unit as claimed in claim 22, wherein the electronic unit is configured for a switching installationfor a high or medium voltage.

* * * * *